US006240267B1

(12) United States Patent
Compera

(10) Patent No.: US 6,240,267 B1
(45) Date of Patent: May 29, 2001

(54) PRINTING APPARATUS AND METHOD USING A SLEEVED DRUM

(75) Inventor: Christian Compera, Schoenau (DE)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 09/534,468

(22) Filed: Mar. 24, 2000

(30) Foreign Application Priority Data

Apr. 27, 1999 (DE) ..... 199 18 943

(51) Int. Cl.[7] ..... G03G 15/00
(52) U.S. Cl. ..... 399/117; 399/159
(58) Field of Search ..... 399/116, 117, 399/159, 110, 121, 303; 101/415.1

(56) References Cited

U.S. PATENT DOCUMENTS 4,134,667 * 1/1979 Schnall et al. ..... 399/159 X
4,823,160 * 4/1989 Ikuta et al. ..... 399/117
5,130,751 * 7/1992 Sato et al. ..... 399/117 X
5,722,013 * 2/1998 Nagase et al. ..... 399/117 X

* cited by examiner

*Primary Examiner*—Sophia S. Chen
(74) *Attorney, Agent, or Firm*—Lawrence P. Kessler

(57) ABSTRACT

The invention concerns a printing apparatus including a cylinder, mounted in side walls, that has a sleeve-shaped sheath that can be replaced through an opening in a side wall. The object of the invention is to develop a printing apparatus in which replacement of a sleeve-shaped sheath is simplified, and the risk of damage to the sheath is reduced. The invention proposes that a detachably attached sheath (19) that projects laterally from the cylinder (1) on the side toward the opening be provided on the enveloping surface (18) of the cylinder (1); that a holding apparatus (23, 24, 25, 26, 28), which can be set against and moved away from the interior of the projecting part (21) of the sheath (19), be provided for the sheath (19), the holding apparatus (23, 24, 25, 26, 28) being physically integrated with a bearing element (16) of the cylinder (1); and that in order to replace the sheath, the bearing element (16) can be positioned in a location which uncovers the opening. The invention is applicable to electrostatic, electrophotographic, and magnetographic printing apparatuses.

17 Claims, 2 Drawing Sheets

PRINTING APPARATUS AND METHOD USING A SLEEVED DRUM

The invention concerns a printing apparatus and, more particularly, an apparatus and method using a sleeved printer drum.

The invention is applicable to printing presses and other fields of printing, including electrography, electrophotography and magnetography.

In the fields of electrography, electrophotography, or magnetography, electrical or magnetic magnitudes are distributed in recording materials in accordance with a printed image. Electrophotography uses photoconductor drums on whose respective enveloping surfaces is applied a photoconductive layer that is discharged in response to light in a manner equivalent to the image. The recording materials have only a limited service life, which is why in the case of high-production printing apparatuses, the entire cylinder or layer support for the recording material must be replaced relatively frequently. In multi-color printing apparatuses, replacing the recording materials is particularly time-consuming. Recording materials are particularly sensitive. The recording materials must not be touched, and must not be exposed to ambient light for longer than necessary. Photoconductor drums are therefore equipped with special protective coverings and with handles for installation in a printing apparatus. For physical reasons, a photoconductor drum is often installed in an arrangement parallel with the rotation axis of the drum.

In the case of rotation printing presses, it is known from U.S. Pat. No. 5,241,905 to replace a sleeve-shaped rubber printing blanket laterally through a side wall in which the cylinder carrying the rubber blanket is mounted (DE 43 32 364 A1). With this approach, an opening that is closed off during printing by a door is provided in the side wall. The housing of the cylinder bearing is clamped in place on the door. The external dimensions of the bearing are smaller than the inside diameter of the sleeve-shaped rubber blanket. In order to replace the rubber blanket, the clamped attachment of the bearing on the door is released, and the door is swung aside in front of the opening. The rubber blanket can be removed by hand, through the side door, by way of the bearing which remains in place on the bearing journal of the cylinder, and then reinstalled. The rubber blanket is of elastic configuration and insensitive to contact. During printing, the rubber blanket cylinder has associated with it a cleaning apparatus with which the surface of the rubber blanket is cleaned before printing.

It is an object of the invention to develop a printing apparatus and method in which the replacement of a sleeve-shaped sheath is simplified, and the danger of damage to the sheath is reduced.

The object is achieved in accordance with a first aspect of the invention. There is provided a printing apparatus comprising a cylinder mounted between side walls and having a sleeve-shaped sheath that can be replaced through an opening on one of the side walls, wherein the sheath is detachable from the cylinder and has a projecting part that projects laterally from the cylinder on the side toward the opening, the sheath being supported on an enveloping surface of the cylinder, a holding apparatus which can be set against and moved away from the interior of the projecting part of the sheath, the holding apparatus being physically integrated with a bearing element of the cylinder, and in order to replace the sheath, the bearing element can be positioned in a location which uncovers the opening.

According to the invention, several precautions are taken to ensure that the sheath can be installed without damage.

The sleeve-shaped sheath possesses, in addition to the actual functional surface used during printing, a clamping surface on its projecting part that can have a smaller diameter than the outer enveloping surface of the functional surface. Engaging onto the projecting part is a holding or clamping apparatus for the sheath which takes effect when the frictional or positive engagement between the sheath and the enveloping surface of a cylinder that carries the sheath is abolished, for example by the generation of an air cushion. While the sheath is being expanded, for example by the air cushion, the sheath can be held on the projecting part by the holding apparatus, by the fact that there acts on the interior of the projecting part a clamping apparatus that includes elements which are movable toward the outside, so that the projecting part is expanded sufficiently that it rests at the outer circumference against a clamping surface that is incorporated into a bearing element for the cylinder in a side wall of a printing apparatus. The use of an air cushion between the inner side of the sheath and the outer side of the cylinder is mentioned only by way of example. All that is important is that the holding forces between the sheath and the cylinder are temporarily abolished, which in the case of a ferrous-metal sheath and magnetic clamping can occur by abolishing the magnetic field, or by extending rolling elements, so that the large holding friction between the sheath and cylinder is replaced by a small rolling friction. Actuation of the clamping apparatus for the rim of the sheath can be accomplished manually by actuating a positioning lever that is easily accessible from outside. It is also possible to provide holding or clamping apparatus whose holding or clamping forces are generated by a pneumatic or hydraulic system. As a result of the physical unification of the holding apparatus and the bearing element, the bearing element that is removable from the side wall serves simultaneously as an installation aid when replacing the sheath. The bearing element is completely removed, together with the sheath, from the side wall and from the bearing journal of the cylinder.

Sheath replacement can be performed completely automatically if manipulation apparatuses which displace the bearing element laterally in the direction of the rotation axis are provided on the exterior of the printing apparatus.

Because the sheath is handled gently, the invention is applicable in particular to printing apparatuses in which the sheath has a charge-accepting layer. In the case of printing apparatuses having an image cylinder and a transfer cylinder for toner, each possessing a sheath, the holding apparatuses for the sheaths can be provided on a shared bearing element. As a result, the two sheaths can be replaced simultaneously. In the case of multi-cylinder arrangements, it is possible to provide apparatuses which move the cylinders apart from one another prior to sheath replacement.

The invention will be explained in further detail with reference to an exemplary preferred embodiment; in the drawings.

Figure 1:
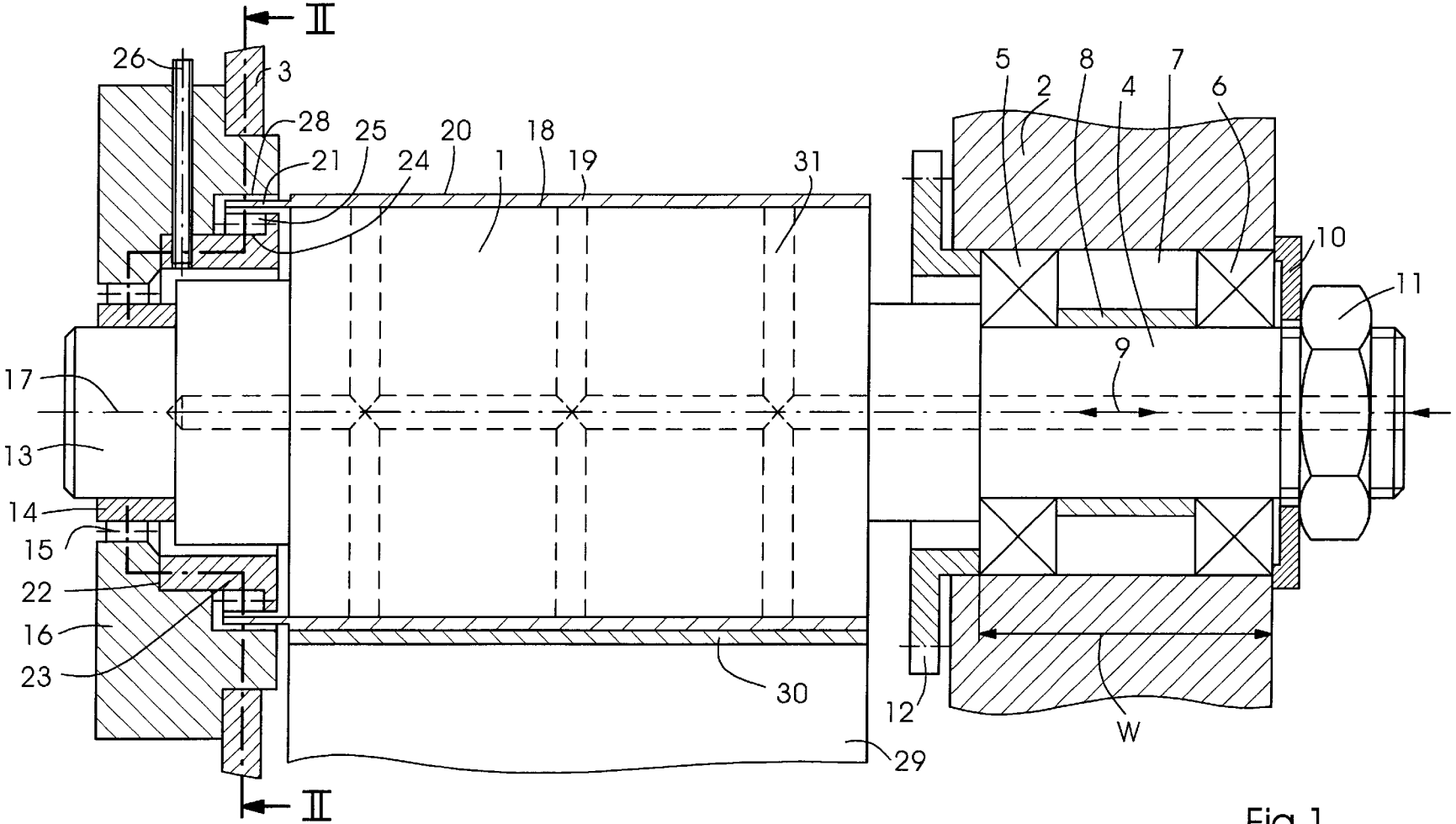
FIG. 1 shows a diagram of a cylinder bearing assembly.
Figure 2:
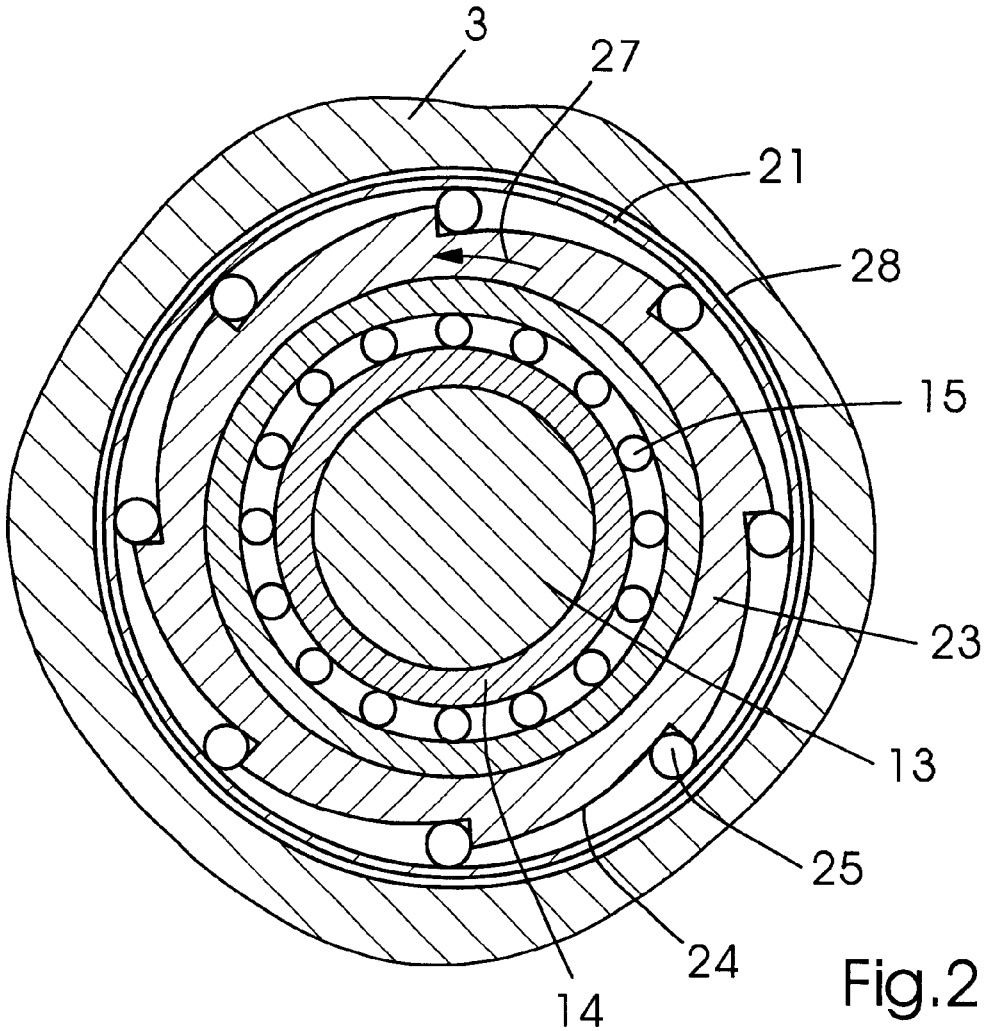
FIG. 2 shows a sectioned depiction of FIG. 1 along line II—II.

FIG. 1 shows a cylinder or drum 1 of an electrophotographic printing apparatus. Cylinder 1 is mounted in side walls 2, 3. Cylinder 1 possesses a bearing journal 4 having a relatively long journal length w. Bearing journal 4 is mounted with two rolling bearings 5, 6 in an orifice 7 of side wall 2. Rolling bearings 5, 6 are spaced apart from one another by a spacer 8, thus imparting to bearing journal 4 a large support width w in side wall 2 in axial direction 9. Bearing journal 4 is secured against displacement in axial direction 9 by way of a washer 10, a nut 11, and a ring 12 that is screwed against side wall 2. Bearing journal 13 facing toward side wall 3 sits in a clearance fit of an inner bearing ring 14 of a rolling bearing 15. Rolling bearing 15 is braced toward the outer portion of an opening of a bearing element 16 which bearing element is attached detachably to side wall 3 from the outside. The opening of bearing element 16 lies concentrically with rotation axis 17 of cylinder 1. A support sleeve 19 is pulled onto enveloping surface 18 of cylinder 1. Support sleeve 19 possesses externally, in the region of enveloping surface 18, a functional surface, e.g. a photoconductive surface 20. At the end associated with side wall 3, support sleeve 19 projects beyond enveloping surface 18. Projecting part 21 of support sleeve 19 has an outside diameter smaller than the diameter in the region of enveloping surface 18. The orifice in bearing element 16 has a shoulder 22 in which a cam member 23 is mounted rotatably concentrically with rotation axis 17. Cam member 23 possesses on its circumference uniformly distributed cam bevels 24 for roller-shaped rolling elements 25. The rotation axes of rolling elements 25 lie parallel to rotation axis 17 of cylinder 1. Cam member 23 is secured against displacement in the direction of its rotation axis by an actuation lever 26 in bearing element 16. To accomplish a rotation of cam member 23 in an angular range of approximately 300, actuation lever 26, which projects externally from bearing element 16, is provided in the radial direction on cam member 23.

A description will now be given of the manner in which replacement of support sleeve 19 proceeds. In a first step, actuation lever 26, which is arranged rotatably in a radial slot in bearing element 16, is brought into the clamped position. Cam member 23 thereby rotates relative to bearing element 16 in direction 27 that is indicated. As a result of the rotation of cam member 23, rolling elements 25 move radially outward until they come into contact against the inside diameter of projecting part 21 of support sleeve 19. Upon further rotation of cam member 23 in direction 27, projecting part 21 is expanded in its elastic region until the projecting part comes to rest with its outer surface against a clamping surface 28 of bearing element 16, and is immobilized.

In a further step, an air cushion is generated between enveloping surface 18 and the inner surface of support sleeve 19 via air ducts 31. As a result of a slight radial expansion of support sleeve 19, the adhesion between enveloping surface 18 and support sleeve 19 is abolished. In a subsequent step, the attachment of bearing element 16 to side wall 3 is released. Bearing element 16 can be moved away from side wall 3 in the direction of rotation axis 17 until support sleeve 19, held between rolling elements 25 and clamping surface 28, is pulled completely off from cylinder 1. When bearing element 16 is moved away, cylinder 1 is no longer supported on bearing journal 13. In this state, cylinder 1 is held only in side wall 2; because of the large support width w, the deformations of the elements that support bearing journal 4 remain within permissible limits.

By releasing the clamping on bearing element 16, support sleeve 19 can be set down at a predefined location or in a container without manual contact.

After bearing element 16 has been removed, and after support sleeve 19 has been pulled off enveloping surface 18, support sleeve 19 can be brought into any desired position. For manual removal, corresponding handles can be configured on bearing element 16.

The fitting of cylinder 1 with a new support sleeve 19 is accomplished in the reverse order. The new support sleeve 19 is clamped in bearing element 16 by moving actuation lever 26 in bearing element 16. Support sleeve 19 is slipped over enveloping surface 18 by positioning bearing element 16. As it is slipped over enveloping surface 18, the aforesaid air cushion is once again created, so that support sleeve 19 can easily slide over enveloping surface 18. Once bearing element 16 has been immobilized in side wall 3, the air cushion can be eliminated and the clamping of projecting part 21 to clamping surface 28 can be released. Cylinder 1 is then free to rotate. Projecting part 21 runs in an open space between clamping surface 28 and rolling elements 25.

In addition to the rolling element clamping catch described above for clamping in projecting part 21, it is possible to use other mechanical designs that, for example by way of pneumatic or magnetic actuators, radially move elements which clamp support sleeve 19 in place on projecting part 21 of bearing element 16.

Cylinder 1 is driven by frictional engagement with a transfer cylinder 29 for toner, which also has an elastic sheath 30. In a variant of the invention, this sheath 30 can be replaced in the same manner as support sleeve 19. This requires that cylinder 1 and transfer cylinder 29 be moved apart from one another. If a projecting part is configured on sheath 30 as well, the clamping apparatuses for support sleeve 19 and sheath 30 can be of similar configuration; this would make it possible to provide the clamping apparatus on a single bearing element, so that support sleeve 19 and sheath 30 can be replaced simultaneously.

What is claimed is:

1. A printing apparatus, including a cylinder mounted in side walls and having a sleeve-shaped sheath that can be replaced through an opening in a side wall, comprising:

a detachably attached sheath having a portion that projects laterally from the cylinder on the side toward the opening is provided on an enveloping surface of the cylinder;

a holding apparatus, which can be set against and moved away from the interior of the projecting portion of the sheath, is provided for the sheath, the holding apparatus being physically integrated with a bearing element of the cylinder, wherein the bearing element is displaceable in the direction of the rotation axis of the cylinder by an amount which is greater than a width of the enveloping surface; and in order to replace the sheath, the bearing element can be positioned in a location which uncovers the opening.

2. The printing apparatus as defined in claim 1, wherein the sheath has a charge-accepting surface in a region of the enveloping surface, and clamping surfaces are configured on the projecting part which, upon actuation of the holding apparatus, come into contact against a clamping surface of the bearing element.

3. The printing apparatus as defined in claim 1, wherein the sheath has, in a region of the enveloping surface, a surface which transfers toner.

4. The printing apparatus is defined in claim 1 wherein the sheath includes a photoconductive layer.

5. A printing apparatus comprising:

a drum, the drum having a support surface;

an axially movable bearing element for supporting the drum for rotation about a rotational axis of the drum;

a sleeve-shaped sheath supported on the support surface of the drum for rotation therewith, the sheath having an edge portion; and an adjustable sheath clamp which is adjustable to grip against the edge portion of the sheath, the clamp being physically integrated with the bearing element for movement therewith, the clamp being operable upon being adjusted to grip the edge portion and remove the sheath from the support surface during movement of the bearing element away from the drum.

6. The printing apparatus as defined in claim 5, wherein the sheath has a charge-accepting surface.

7. The printing apparatus of claim 6, wherein the sheath clamp includes members that are adjustable in position to be moved toward an inner surface of the edge portion of the sheath to engage the edge portion of the sheath.

8. The printing apparatus as defined in claim 5, wherein the sheath has a surface which transfers toner.

9. The printing apparatus as defined in claim 5, wherein the bearing element is displaceable in the direction of the rotational axis of the drum by an amount which is greater than the width of the surface of the drum.

10. The printing apparatus as defined in claim 5, wherein the movement of the bearing element is in a direction parallel to the rotation axis of the drum.

11. The printing apparatus as defined in claim 10, wherein the sheath includes a photoconductive layer.

12. The printing apparatus as defined in claim 10, wherein the sheath includes a surface suitable for transferring toner.

13. A method for removing a sleeve-shaped sheath from a surface of a drum;

supporting the drum with a bearing element to provide rotation of the drum about an axis during a printing operation;

clamping an edge portion of the sheath with a clamping member; and moving the bearing element away from the drum so that movement of the bearing element also causes movement of the clamping member to advance the sheath axially along the surface of the drum.

14. The method according to claim 13, wherein the sheath includes a photoconductive layer.

15. The method according to claim 13, wherein the sheath has a surface for transferring toner.

16. The method according to claim 13, wherein the clamping member includes members which move against an inner surface of the sheath to clamp the sheath and the members are not in engagement with the inner surface of the sheath during rotation of the drum during the printing operation.

17. The method according to claim 16, wherein the movable bearing element is supported by a first wall and a second bearing element for supporting the drum is supported by a second wall, and wherein the second bearing element supports the drum after the movable bearing element moves out of supporting relationship with the drum.

* * * * *